US006814605B2

(12) United States Patent
Masumoto

(10) Patent No.: US 6,814,605 B2
(45) Date of Patent: Nov. 9, 2004

(54) CONNECTOR HAVING A SHIELDING SHELL PROVIDED WITH A LOCKING PORTION

(75) Inventor: Toshio Masumoto, Musashimurayama (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/304,507

(22) Filed: Nov. 26, 2002

(65) Prior Publication Data

US 2003/0104726 A1 Jun. 5, 2003

(30) Foreign Application Priority Data

Nov. 30, 2001 (JP) ..... 2001-367586

(51) Int. Cl.[7] ..... H01R 13/627
(52) U.S. Cl. ..... 439/353
(58) Field of Search ..... 439/353, 352, 439/357

(56) References Cited

U.S. PATENT DOCUMENTS 5,236,375 A * 8/1993 Kachlic ..... 439/607
5,660,558 A * 8/1997 Osanai et al. ..... 439/353
6,071,141 A * 6/2000 Semmeling et al. ..... 439/353
6,257,914 B1 * 7/2001 Comerci et al. ..... 439/357
6,358,089 B1 * 3/2002 Kuroda et al. ..... 439/607
6,540,542 B1 * 4/2003 Simmel ..... 439/352

FOREIGN PATENT DOCUMENTS

| | | |
|---|---|---|
| JP | 4-52389 | 5/1992 |
| JP | 4-55769 | 5/1992 |
| JP | 5-43486 | 6/1993 |
| JP | 5-65079 | 8/1993 |
| JP | 6-19284 | 3/1994 |
| JP | 11-185879 | 7/1999 |
| JP | 2000-252018 | 9/2000 |

* cited by examiner

*Primary Examiner*—Phuong Dinh
(74) *Attorney, Agent, or Firm*—Collard & Roe, P.C.

(57) ABSTRACT

A connector (11) has a locking portion (13*b*) for locking a connected state in which the connector is connected to a mating connector (1). The locking portion is integral with a conductive shielding shell (13) covering an insulator housing (12) holding a conductive contact (14*a*). The housing has a guide portion (12*a*) for guiding the mating connector when it is connected. The locking portion is formed at a position corresponding to the guide portion.

6 Claims, 11 Drawing Sheets

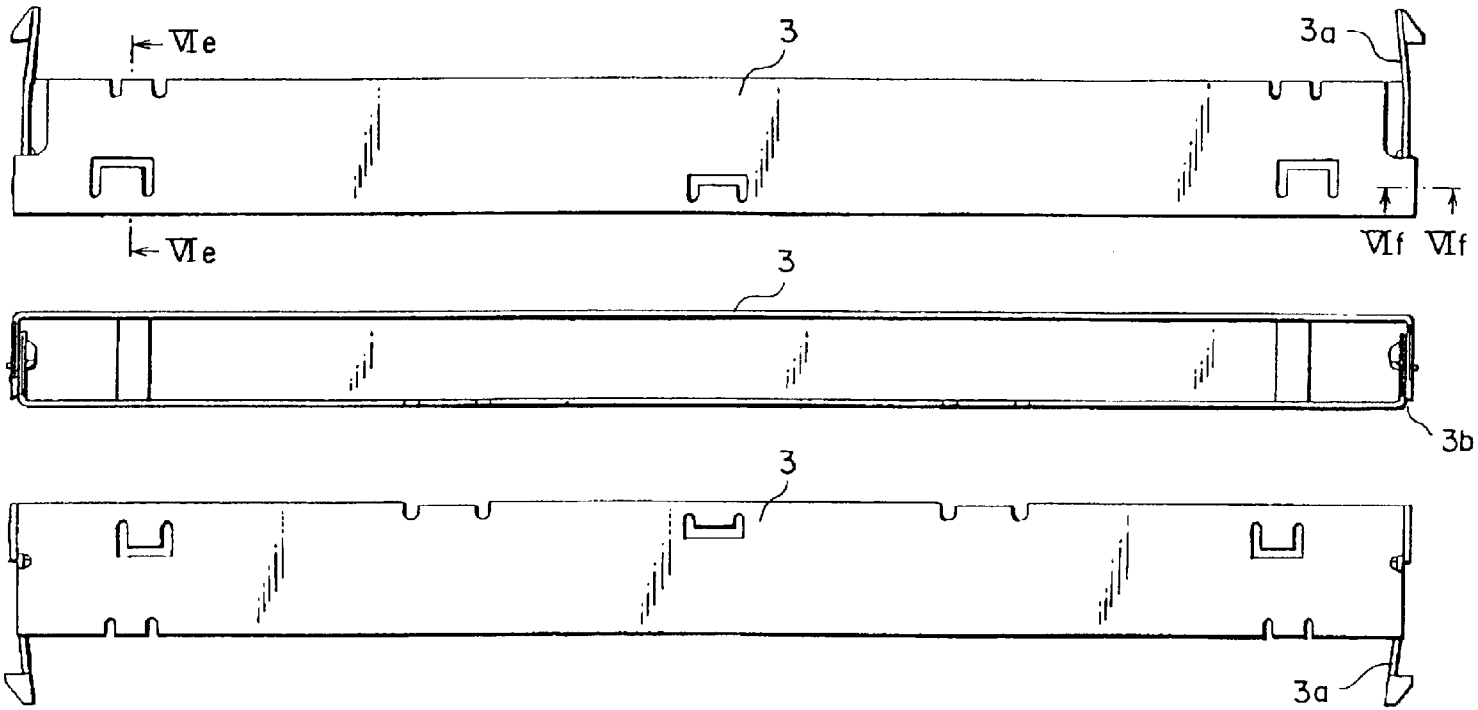
FIG. 6A
FIG. 6B
FIG. 6C
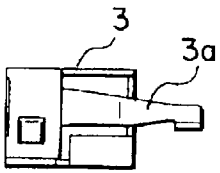
FIG. 6D

CONNECTOR HAVING A SHIELDING SHELL PROVIDED WITH A LOCKING PORTION

BACKGROUND OF THE INVENTION

This invention relates to a connector and, in particular, to a connector capable of locking a connected state in which the connector is connected to a mating connector.

A connector of the type is disclosed, for example, in Japanese Unexamined Utility Model Publication No. 43486/1993 (JP 5-43486 U). The connector comprises a mold base and a shielding cover covering the mold base. The mold base is formed by an insulator and has a flat portion. The flat portion is provided with an insert portion protruding from its center. The insert portion holds a conductive contact.

The shielding cover comprises a shell having an electromagnetic shielding function for the contact, and a locking member formed as a component separate from the shell and adapted to be engaged with a mating connector. The locking member is put on the shell and, in this state, coupled with the mold base.

In the above-mentioned manner, the connector is assembled. With this structure, the connector is provided with so-called EMI protection and has a locking function assuring strong retention between the connector and the mating connector.

However, the EMI protection and the locking function are achieved by the separate components, i.e., the shell and the locking member. This makes it difficult to avoid an increase in production cost of the connector resulting from an increase in number of components. The production cost includes die cost, material cost, machining cost, assembling cost, and so on.

SUMMARY OF THE INVENTION

It is therefore an object of the present invention to provide a connector which is provided with EMI protection and has strong retention sufficient to maintain a connected state and which can be produced with a reduced number of components.

Other objects of the present invention will become clear as the description proceeds.

According to an aspect of the present invention, there is provided a connector including first and second connector elements adapted to be connected to and disconnected from each other, the first connector element comprising a first contact, a first housing holding the first contact, a first shielding shell covering the first housing, a first guide portion formed in the first housing, and a first locking portion coupled to the first shielding shell and faced to the first guide portion, the second connector element comprising a second contact, a second housing holding the second contact, a second shielding shell covering the second housing, a second guide portion integral with the second housing and adapted to be guided by the first guide portion, and a second locking portion coupled to the second shielding shell, faced to the second guide portion, and adapted to be locked to the first locking portion.

According to another aspect of the present invention, there is provided a connector having a locking portion for locking a connected state in which said connector is connected to a mating connector, the connector comprising a conductive contact, an insulator housing holding the contact, and a conductive shielding shell covering the housing, the housing having a guide portion for guiding the mating connector when the mating connector is connected, the locking portion being integral with the shielding shell and formed at a position corresponding to the guide portion.

BRIEF DESCRIPTION OF THE DRAWINGS

FIG. 6A is a plan view of a shielding shell of the cable connector;

FIG. 6B is a rear view of the shielding shell of the cable connector;

FIG. 6C is a bottom view of the shielding shell of the cable connector;

FIG. 6D is a side view of the shielding shell of the cable connector;

DESCRIPTION OF THE PREFERRED EMBODIMENTS

Figure 1:
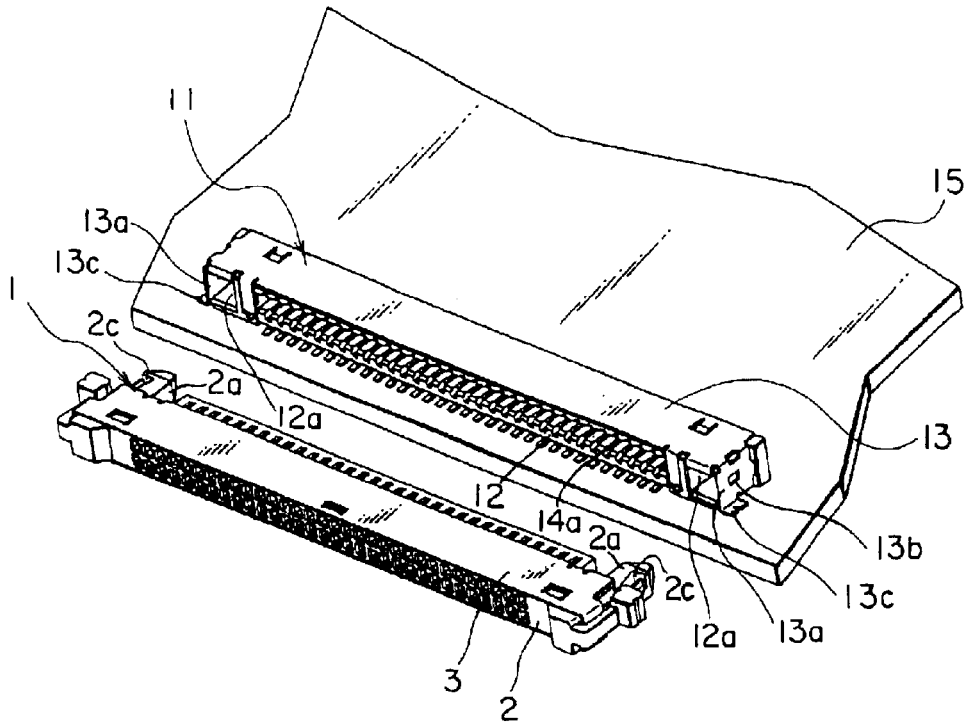
FIG. 1 is a perspective view of a connector, including a cable connector and a board connector, according to an embodiment of the present invention in a disconnected state, with the board connector mounted on a board.
Figure 2:
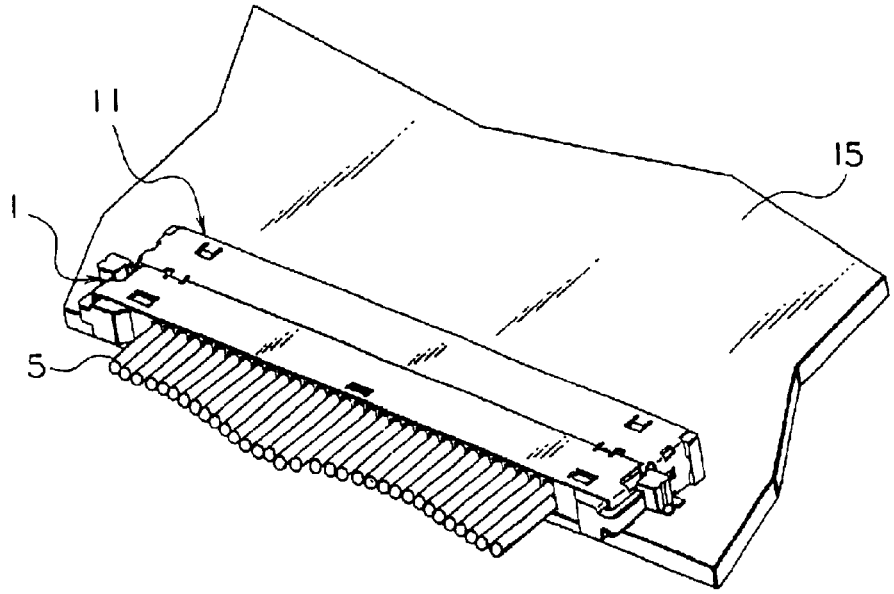
FIG. 2 is a perspective view of the connector in FIG. 1 in a connected state, with the cable connector connected to a cable.
Figure 2A:
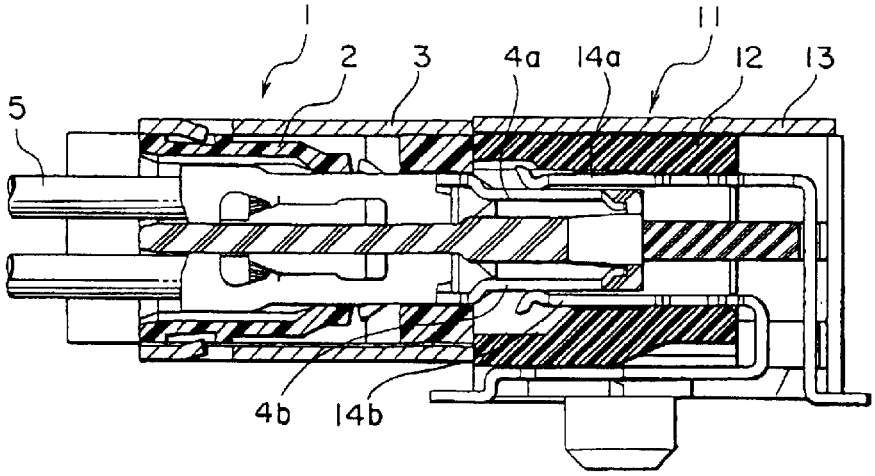
FIG. 2A is a sectional view of the connector illustrated in FIG. 2.

Referring to FIGS. 1, 2, and 2A, description will be made as regards a whole of a connector according to an embodiment of the present invention.

The connector illustrated in the figures is mainly used for an LCD monitor and comprises a cable connector 1 and a board connector 11 to be connected to and disconnected from each other. The board connector 11 is referred to as a first connector element. The cable connector 1 is referred to as a second connector element.

The cable connector 1 comprises an insulator housing 2 having upper and lower housing parts, a conductive shielding shell 3 covering the housing 2, a plurality of conductive contacts 4*a* and 4*b* held by the housing 2 and aligned in upper and lower rows. On the other hand, the board connector 11 comprises an insulator housing 12 having upper and lower housing parts, a conductive shielding shell 13 covering the housing 12, and a plurality of conductive contacts 14*a* and 14*b* held by the housing 12 and aligned in upper and lower rows.

To the contacts 4*a* and 4*b* of the cable connector 1, a plurality of cables 5 are crimped and connected, respectively. The board connector 11 is mounted on a board 15 and the contacts 14*a* and 14*b* are connected to an electric circuit (not shown) on the board 15.

The housing 2 has a coupling side for coupling to the board connector 11. A pair of guided portions 2*a* is integral with the housing 2 and protrudes therefrom at transversal opposite ends on the coupling side of the housing 2. Each of the guided portions 2*a* has a cut portion 2*c*. Above the cut portion 2*c*, a locked arm 3*a* of the shielding shell 3 is located. The locked arm 3*a* has an inclined end 3*e*.

The housing 12 of the board connector 11 is provided with a pair of guiding portions 12*a* depressed at transversal opposite ends thereof. Each of the guiding portions 12*a* has an open end closed by a side surface portion 13*a* of the shielding shell 13. Each side surface portion 13*a* has a hole 13*b* and a soldered portion 13*c*. In the manner which will later be described, the hole 13*b* serves as a locking portion for locking a connected state in which the board connector 11 is connected to the cable connector 1.

Figure 3C:
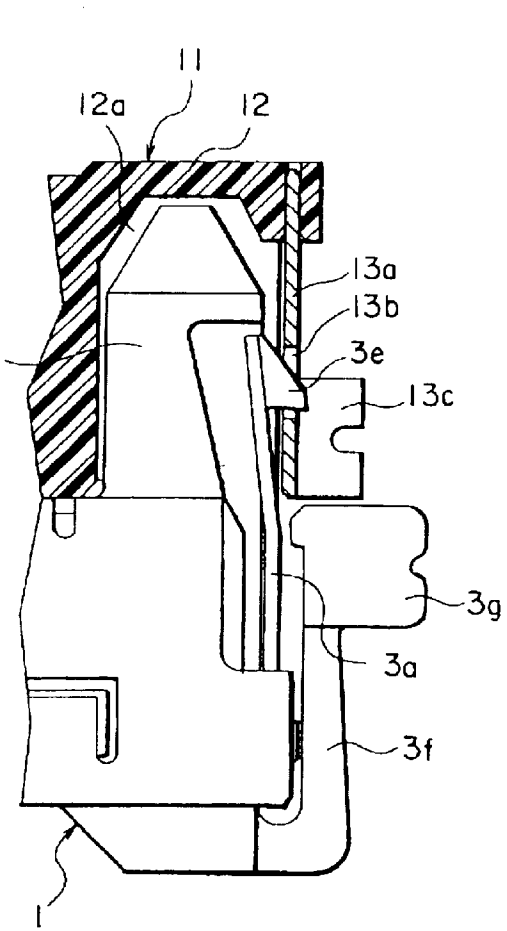
FIGS. 3A–3C are views for describing an operation of a locking portion when the connector in FIG. 1 is put into the connected state.
Figure 3B:
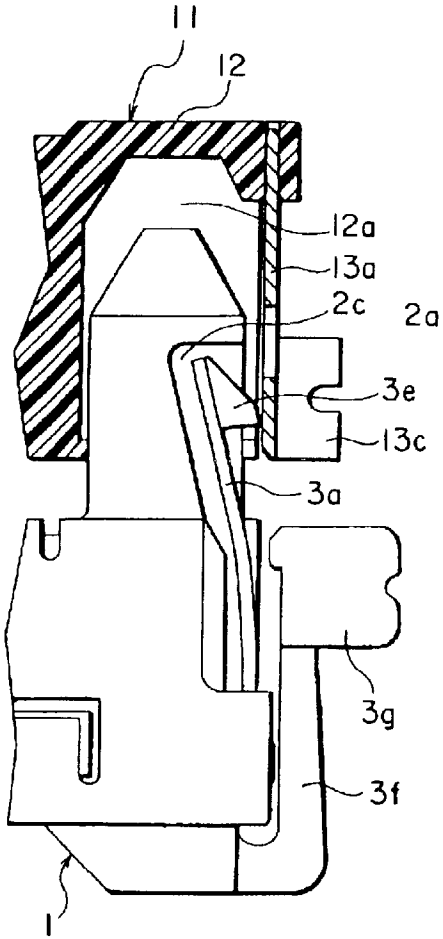
Figure 3A:
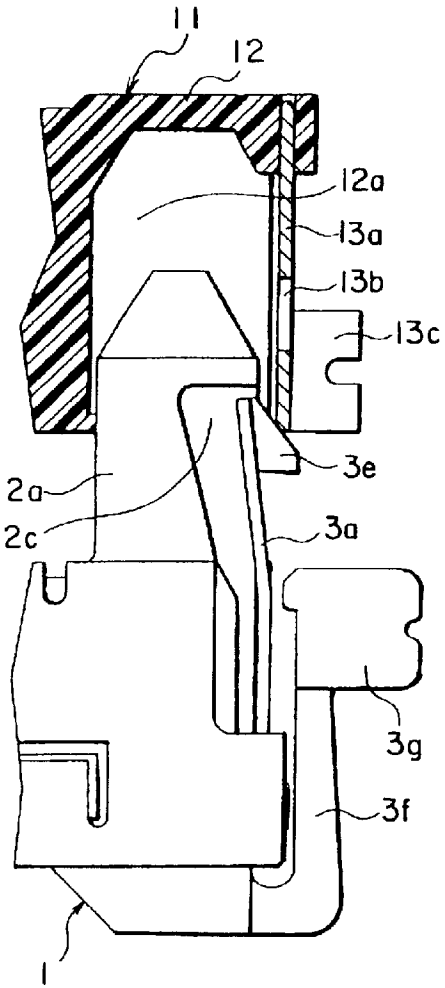

Referring to FIGS. 3A to 3C, the description will be directed to an operation of connecting the cable connector 1 and the board connector 11.

When the cable connector 1 is fitted to the board connector 11, the inclined end 3*e* of the locked arm 3*a* is brought into contact with the side surface portion 13*a*, as illustrated in FIG. 3A. When the cable connector 1 is pushed further, the locked arm 3*a* is elastically deformed so that the inclined end 3*e* enters into the cut portion 2*c*, as illustrated in FIG. 3B. When the guided portion 2*a* enters further inward into the guiding portion 12*a*, the locked arm 3*a* is restored so that the inclined end 3*e* is inserted into the hole 13*b*, as illustrated in FIG. 3C. As a consequence, the inclined end 3*e* of the locked arm 3*a* is engaged with an edge of the hole 13*b* of the shielding shell 13. Thus, the cable connector 1 and the board connector 11 are locked to each other in a connected state.

The guided portions 2*a* of the cable connector 1 are formed at the transversal opposite ends of the housing 2 to be asymmetrical with each other while the guiding portions 12*a* of the board connector 11 are formed at the transversal opposite ends of the housing 12 to be asymmetrical with each other. With this structure, when the cable connector 1 is fitted to the board connector 11, it is possible to inhibit coupling error such that left and right sides, in other words, upper and lower surfaces are erroneously reversed.

The shielding shell 3 has opposite side surfaces provided with a pair of unlocking arms 3*f* integral with the housing 2 and adjacent to outer surfaces of the locked arms 3*a*. Each of the unlocking arms 3*f* has a finger push portion 3*g* formed at its end.

Figure 4:
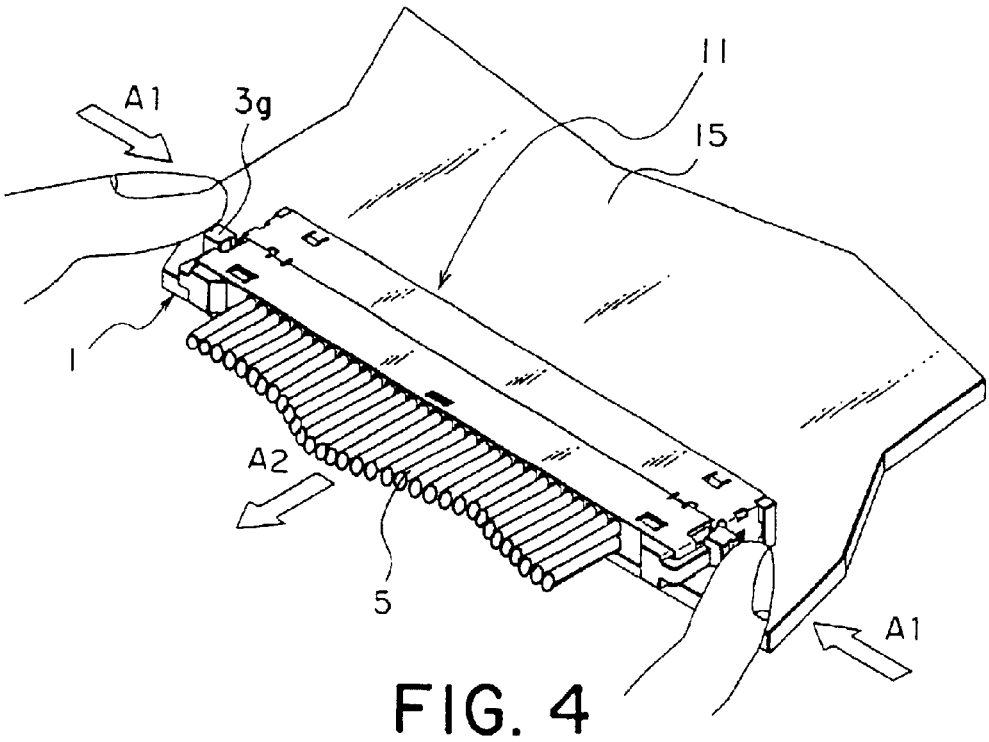
FIG. 4 is a perspective view for describing an operation when the connector in FIG. 2 is put into the disconnected state.
Figure 4A:
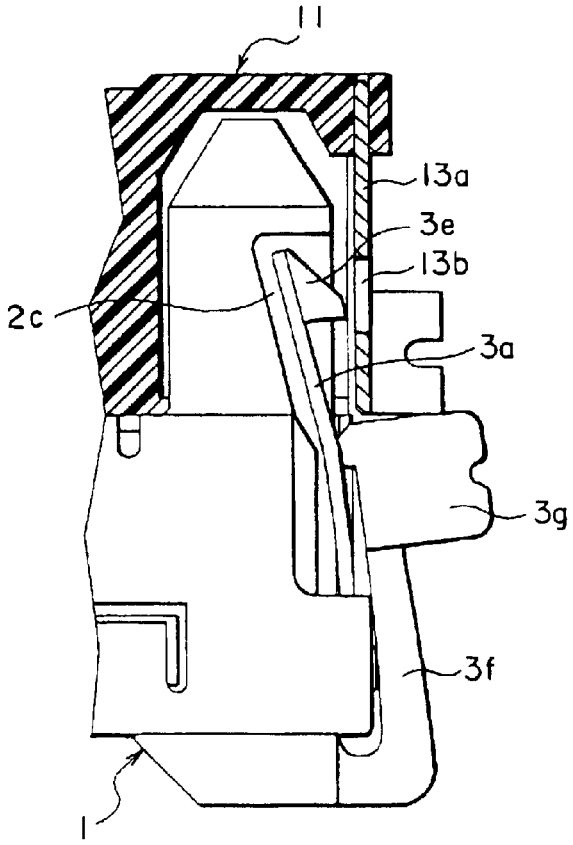
FIG. 4A is a sectional view of the connector when the operation of FIG. 4 is carried out.
Figure 5A:
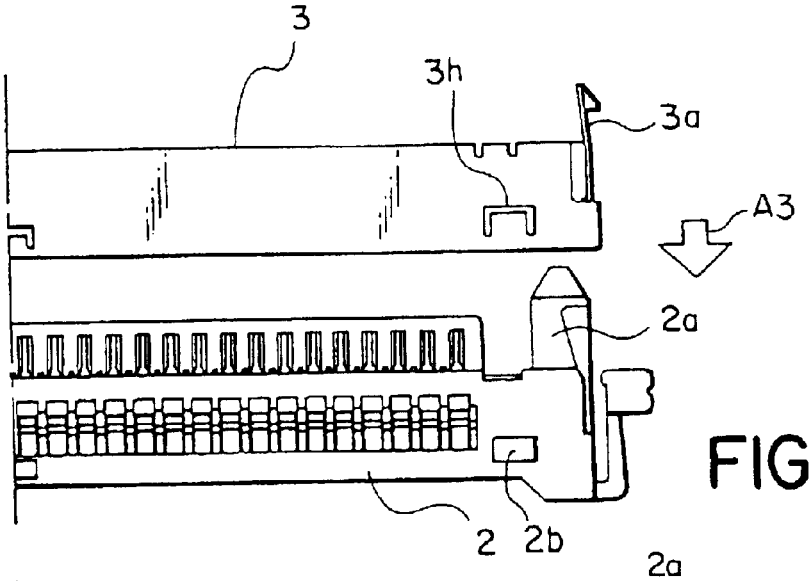
FIGS. 5A–5C are plan views of a half of the cable connector, for describing an assembling operation of the cable connector.
Figure 5B:
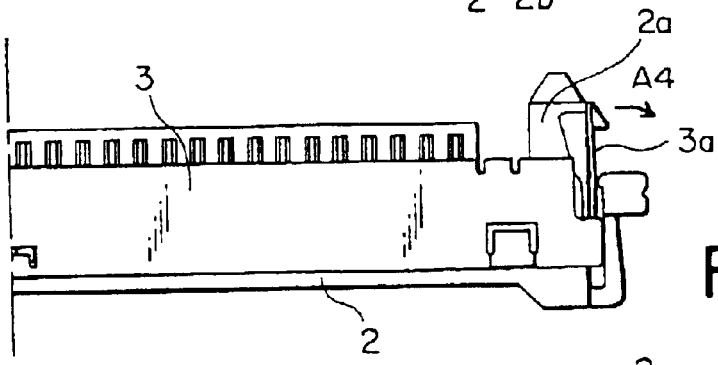
Figure 5C:
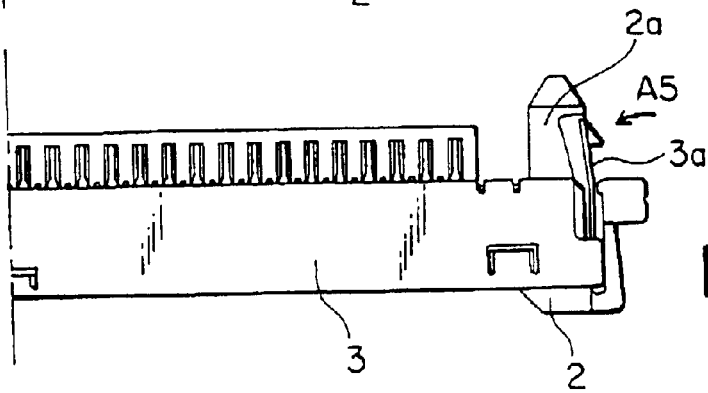
Figure 5D:
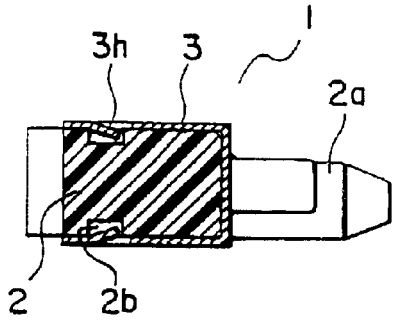
FIG. 5D is a sectional view of the cable connector after it is assembled.
Figure 6E:
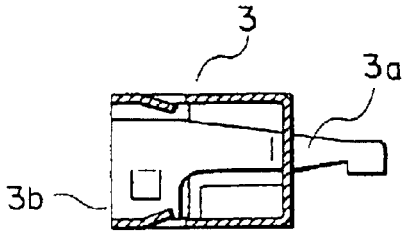
FIG. 6E is a sectional view taken along a line VIe—VIe in FIG. 6A.
Figure 6F:
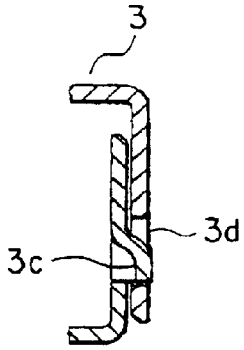
FIG. 6F is a sectional view taken along a line VIf—VIf in FIG. 6A.

Referring to FIGS. 4 and 4A, the description will be directed to an operation of disconnecting the cable connector 1 and the board connector 11 from each other.

As illustrated in FIG. 4, the finger push portions 3*g* are pressed by fingers in directions depicted by arrows A1, respectively. Then, as illustrated in FIG. 4A, the inclined ends 3*e* escape from the holes 13*b* and enter into the cut portions 2*c*, respectively. In this state, the cable connector 1 is moved with respect to the board connector 11 in a direction A2 in FIG. 4. As a consequence, the cable connector 1 and the board connector 11 are disconnected from each other.

Referring to FIGS. 5A to 5D, the description will be proceeded to an operation of assembling the shielding shell 3 and the housing 2.

The shielding shell 3 is provided with lances 3*h* formed by cutting in the vicinity of transversal opposite ends of upper and lower surfaces thereof. In correspondence to the lances 3*h*, the housing 2 is provided with recesses 2*b* formed in the vicinity of transversal opposite ends of upper and lower surfaces thereof. When the shielding shell 3 is fitted to the housing 2 from the coupling side of the housing 2 in a direction depicted by A3 in FIG. 5A, the state in FIG. 5A proceeds through the state in FIG. 5B to the state shown in FIGS. 5C and 5D. In this state, each lance 3*h* is engaged with each recess 2*b*. In the middle of the fitting, each locked arm 3*a* is brought into contact with each side surface of the housing 2 to be elastically deformed in directions A4 and A5 in FIGS. 5B and 5C.

Referring to FIGS. 6A to 6F and 7, the description will be directed to the shielding shell 3 of the cable connector 1.

Figure 7:
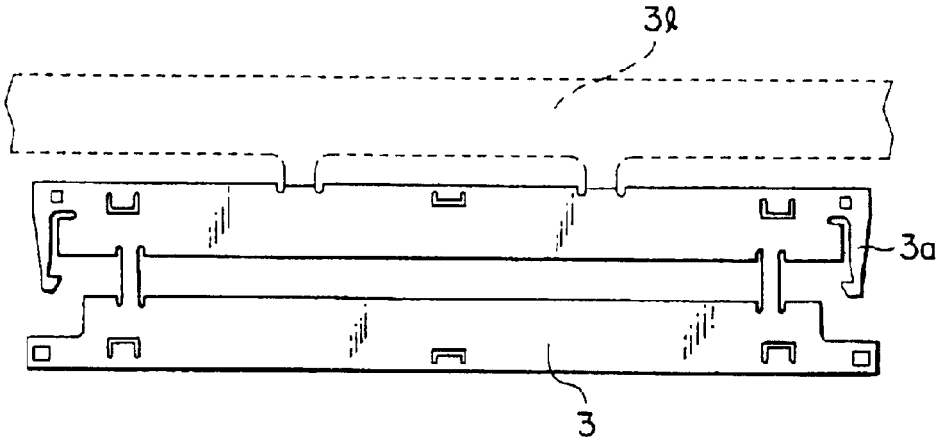
FIG. 7 is a development view of the shielding shell.

The shielding shell 3 of the cable connector 1 is shaped by bending so as to cover four surfaces of the cable connector 1 except the coupling side and the cable side. In FIG. 7, the shielding shell 3 is blanked from a metal plate and is not yet separated from a carrier 3*l* depicted by broken lines. The locked arms 3*a* are formed at the transversal opposite ends of the shielding shell 3 to be integral therewith and to protrude on the coupling side. In FIG. 6A, each of the locked arms 3*a* is elastically deformable from its base 3*b* laterally outwards. Thus, the locked arms 3*a* can be arranged in a space-saving manner. The shielding shell 3 is provided with protruding bent portions 3*c* and holes 3*d* formed on overlapping portions of the opposite side surfaces thereof. By engagement between the protruding bent portions 3*c* and the holes 3*d*, the shielding shell 3 is prevented from being opened laterally outwards.

Figure 8:
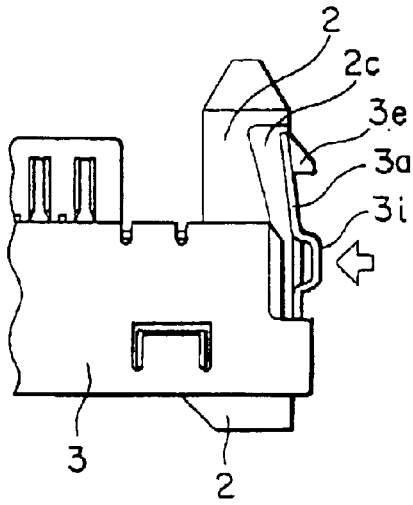
FIG. 8 is a plan view of a part of a modification of the cable connector.

As shown in FIG. 8, the unlocking arm 3*f* and the finger push portion 3*g* formed on the housing 2 may be replaced by a direct finger push portion 3*i* formed by bending the locked arm 3*a* formed on the shielding shell 3.

Figure 9:
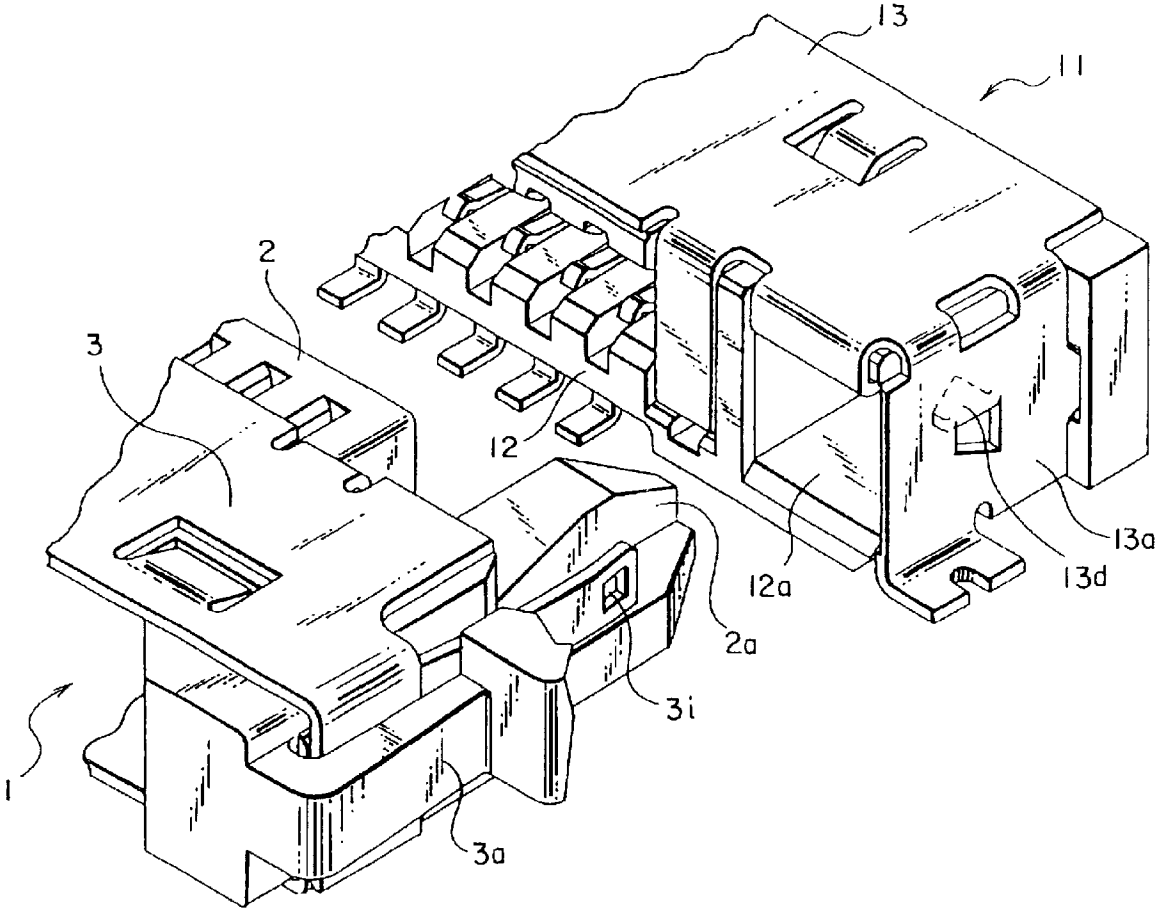
FIG. 9 is a perspective view of a part of a connector according to another embodiment of the present invention in a disconnected state.

Referring to FIG. 9, description will be made as regards a connector according to another embodiment of the present invention. Similar parts are designated by like reference numerals and will not be described any longer.

In the connector in FIG. 9, the locked arm 3*a* of the shielding shell 3 is provided with a recess 3*j* instead of the inclined end 3*e* in the connector in FIGS. 1 to 4A. In correspondence to the recess 3*j*, the side surface portion 13*a* of the shielding shell 13 is provided with a protrusion (locking portion) 13*d* formed by cutting and raising, instead of the hole 13*b* in the connector in FIGS. 1 to 4A.

Figure 10:
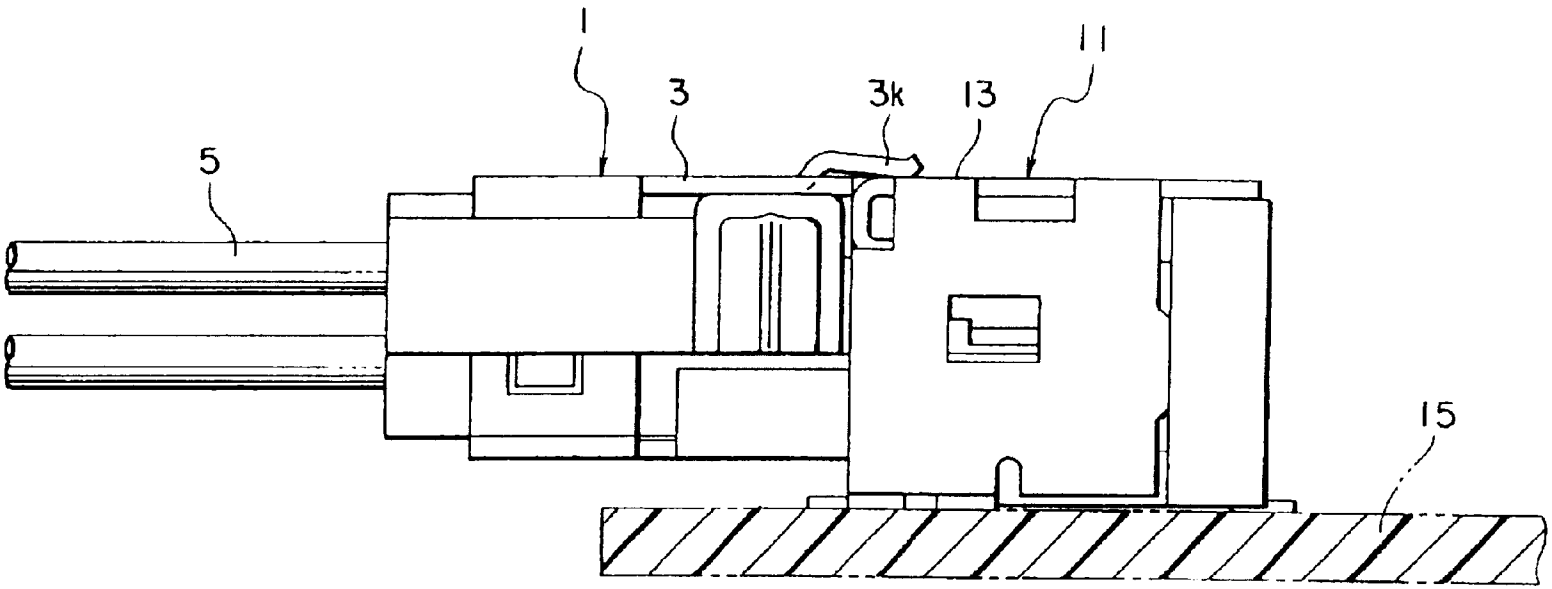
FIG. 10 is a side view of a connector according to still another embodiment of the present invention in a connected state.

Referring to FIG. 10, description will be made as regards a connector according to a still another embodiment of the present invention.

In the connector in FIG. 10, the shielding shell 3 of the cable connector 1 is provided with a contacting member 3*k* formed on an upper surface thereof. The contacting member 3*k* is brought into contact with an upper surface of the shielding shell 13 of the board connector 11 mounted on the board 15 to establish a part of ground connection.

While the present invention has thus far been described in connection with a few embodiments thereof, it will readily be possible for those skilled in the art to put this invention into practice in various other manners. For example, the cable connector 1 is connected to the board connector 11 in parallel thereto in the foregoing description but may be connected to the board connector 11 to be perpendicular thereto. In the foregoing description, the side surface portion 13*a* of the shielding shell 13 of the board connector 11 is provided with the hole 13*b*. Instead, the housing 12 may be provided with a hole as an engaging part.

What is claimed is:

1. A connector including first and second connector elements adapted to be connected to and disconnected from each other, said first connector element comprising:

a first contact;

a first housing holding said first contact;

a first shielding shell covering said first housing;

a first guide portion formed in said first housing; and a first locking portion coupled to said first shielding shell and faced to said first guide portion, said second connector element comprising:

a second contact;

a second housing holding said second contact;

a second shielding shell covering said second housing;

a second guide portion integral with said second housing and adapted to be guided by said first guide portion;

a second locking portion coupled to said second shielding shell through an elastic arm extending along said second guide portion, said second guide portion having a cut portion allowing said first and second locking portions to be unlocked with said elastic arm being bent, said second locking portion facing said second guide portion, and being adapted to be locked to said first locking portion;

said first shielding shell having a side surface portion covering said first guide portion, said cut portion facing said side surface portion when said first and said second connector elements are fitted to each other; and said first locking portion being an engaging protrusion protruding inward from said side surface portion, said second locking portion being an engaging hole formed in said elastic arm, said engaging hole being engaged with said engaging protrusion under elastic force of said elastic arm when said first and second connector elements are fitted to each other.

2. The connector according to claim 1, further comprising an operating portion for bending said elastic arm to unlock said first and said second locking portions.

3. The connector according to claim 2, wherein said operating portion has an elastic unlocking arm coupled to said second housing and faced to said elastic arm.

4. The connector according to claim 2, wherein said operating portion includes a protrusion formed on said elastic arm.

5. The connector according to claim 1, wherein at least one of said first and said second connector elements has a contacting member for electrically connecting said first and said second shielding shells to each other.

6. The connector according to claim 1, comprising a pair of said first guide portions and a pair of said second guide portions, said first guide portions being asymmetrical with each other, said second guide portions being asymmetrical with each other.

* * * * *